United States Patent [19]

Westberg et al.

[11] Patent Number: 4,778,444

[45] Date of Patent: Oct. 18, 1988

[54] ROTATABLE SUPPLY AND DISCHARGE CONDUIT OF A CENTRIFUGAL SEPARATOR

[75] Inventors: Eric Westberg, Lindingo; Lars Ehnstrom, Tullinge, both of Sweden

[73] Assignee: Alfa-Laval Separation AB, Sweden

[21] Appl. No.: 104,860

[22] Filed: Sep. 2, 1987

[30] Foreign Application Priority Data

Sep. 12, 1986 [SE] Sweden ..... 8603851

[51] Int. Cl.[4] ..... B04B 9/00; B04B 11/00

[52] U.S. Cl. ..... 494/56; 494/18; 494/84

[58] Field of Search ..... 494/18, 84, 56; 174/86; 439/13; 464/170; 210/927; 350/574, 539

[56] References Cited

U.S. PATENT DOCUMENTS

| | | | |
|---|---|---|---|
| 3,586,413 | 6/1971 | Adams | 464/170 X |
| 4,109,855 | 8/1978 | Brown et al. | 494/18 |
| 4,114,802 | 9/1978 | Brown | 494/18 |
| 4,459,169 | 7/1984 | Bacehowski et al. | 494/18 X |

*Primary Examiner*—Timothy F. Simone

*Attorney, Agent, or Firm*—Davis Hoxie Faithfull & Hapgood

[57] ABSTRACT

In a centrifugal separator a flexible member for the transport of liquid to or from a centrifuge rotor is arranged to rotate around a rotating rotor in the same direction as the rotor but with only half of its rotational speed. By such rotation the flexible member may be firmly connected with both the rotor and a stationary member without being twisted. According to the invention the flexible member has a high torsional stiffness, good tensile strength and an outside having good wear resistance. The casing comprises interplaited threads which may be metal or plastic, some of which extend helically with a certain pitch around the flexible member and others of which extend helically with an opposite pitch around the member. The interplaiting of the threads is such that the casing per se is axially compressible and expandable under radial expansion and compression, respectively. As mounted, the casing is axially expanded so that through radial compression it is in frictional engagement with the flexible member.

4 Claims, 3 Drawing Sheets

ROTATABLE SUPPLY AND DISCHARGE CONDUIT OF A CENTRIFUGAL SEPARATOR

The present invention relates to a centrifugal separator of the kind comprising a rotor, which forms a separation chamber, and a flexible member forming at least one channel for fluid transport to or from the separation chamber during the rotation of the rotor, the flexible member extending out from one axial end of the rotor at the rotor axis and around the rotor periphery at a distance from the rotor to a point aligned with the rotor axis at the other axial end of the rotor. The flexible member may, for example, consist of a hose.

Centrifugal separators of this kind are disclosed, for example, in U.S. Pat. Nos. 3,586,413 (reissue No. 29,738), 4,109,855 and 4,114,802. As is particularly evident from U.S. Pat. No. 3,586,413 it is possible in connection with operation of a centrifugal separator of this kind to maintain fixed connections without movable sealing means between the flexible member and the rotor as well as between the flexible member and the non-rotatable parts of the centrifuge. For this purpose the flexible member in one way or another must be brought into a rotational movement around the centrifuge rotor in the same direction as and at half the rotational speed of the rotor. This means that the portions of the flexible member which are not entirely straight are subjected to bending, the direction of which gradually changes around the longitudinal axis of the flexible member during the operation of the centrifugal separator.

In connection with centrifugal separators of this kind a problem arises in forming the flexible member in a way such that it will be durable over an extended period. Depending upon how it is connected to the centrifuge rotor and possibly how it is supported by supporting means separate from the centrifuge rotor, it is subjected to large forces of different kinds during the operation of the centrifuge rotor.

If the flexible member is allowed to rotate freely without any support radially outside the centrifuge rotor, e.g. as is shown in U.S. Pat. No. 4,109,855, large forces will appear in its longitudinal direction. In this case it has to be made very strong in its longitudinal direction without reduction of its flexibility. However, even if it is possible to make the flexible member very strong in the longitudinal direction, separate guiding means normally have to be arranged to prevent too severe bending of the flexible member at the places of its connection when it rotates. Such guiding means by bearing against the flexible member will cause shearing forces in it since the flexible member during operation performs a rotational movement relative to each such guiding means. Consequently, in this case the flexible member also has to be made relatively stiff with respect to torsion.

A relatively complicated alternative of making the flexible member torsionally stiff is shown in U.S. Pat. No. 4,114,802. According to this alternative the flexible member is guided close to its connection with the centrifuge rotor by a guiding member which itself is rotatable relative to the rotor around an axis perpendicular to the rotational axis of the rotor and, therefore, does not create substantial shearing forces in the flexible member.

Apart from the above mentioned requirements of strength and torsional stiffness, if the flexible member during its rotation lacks a separate support radially outside the rotor, the fact that the flexible member will take the form of a bow between its places of connection, which puts certain limits on the shape of the rotor, must be considered.

For all of the above mentioned reasons it has proved desirable in practice, particularly if the rotor is relatively large and the flexible member is to transport relatively large quantities of liquid, to provide a separate supporting member for the flexible member during its rotation around the rotor. Such a separte supporting member, which must rotate together with the flexible member, is preferably formed as a stiff tube, in which the flexible member may turn around its own longitudinal axis (see e.g. U.S. Pat. No. 3,586,413).

Even through a support member of this kind will relieve the flexible member from some tension forces to some extent, its supporting function will cause the flexible member to be subjected to large friction forces when it is forced to turn relative to the supporting member, during its rotation relative to the rotor. Large requirements with respect to torsional stiffness and wear resistance of its surface layer are therefore placed on the flexible member.

One object of the present invention is to provide an arrangement in connection with a centrifugal separator of the class described which gives the above described flexible member long durability. Another object is to provide a centrifugal separator of this type which is suitable for use in industry where the rotor has to be relatively large and have a capacity for handling large quantities of liquid.

These objects are fulfilled according to the invention by surrounding the flexible member with a torsionally stiff but flexible casing comprising at least one first thread extending with a certain pitch helically around the flexible member, and at least one second thread extending helically around the flexible member with a pitch directed oppositely to that of the first thread, said threads being twined or plaited together such that the casing itself is axially compressible and expandable during radial expansion and compression, respectively, and that the casing is so axially expanded, when radially compressed, that it is brought in frictional engagement with the flexible member.

In a preferred embodiment of the invention the casing comprises a plurality of first threads, which are separated in groups extending helically around the flexible member like the threads of a multiple-threaded screw, and a plurality of second threads also separated in groups, said groups of first threads being plaited together with the groups of second threads.

The threads in the casing may preferably be made of metal, for instance, stainless steel. It has proved that a casing of threads like this will be sufficiently stiff against torsion to enable driving the rotor by means of the flexible member only. In an arrangement of this kind the casing preferably is firmly connected both with the rotor and with a non-rotatable member and is connected to a driving device by means of which it can be brought into rotation around the rotor with a speed half of the desired speed of the rotor.

By means of a casing of this kind the flexible member may be given high tensile strength as well as high torsional stiffness. Furthermore, the casing is given an outside which by interplaiting of the threads is resistant to wear and offers a reduced friction against any support for the flexible member radially outside the rotor.

Alternatively, the threads may be made of plastic, whereby the casing will have a very small weight and an outer surface offering a very small friction against a surrounding supporting member, for instance of metal, against which it has to abut under movement relative thereto during the operation of the rotor. Even a casing consisting of plastic threads is torsionally very stiff.

In a particular embodiment of a centrifugal separator according to the invention the rotor comprises both a rotor body and a separate member which forms the separation chamber and is movable relative to the rotor body. In this case the flexible member is connected with said separate member, the torsion resistant casing around the flexible member also being connected with the separate member and thus movable therewith relative to the rotor body. The separate member may be formed by an end portion of the flexible member, arranged in a cavity in the rotor body.

The invention will be further described with reference to the accompanying drawings. In the drawings.

Figure 1:
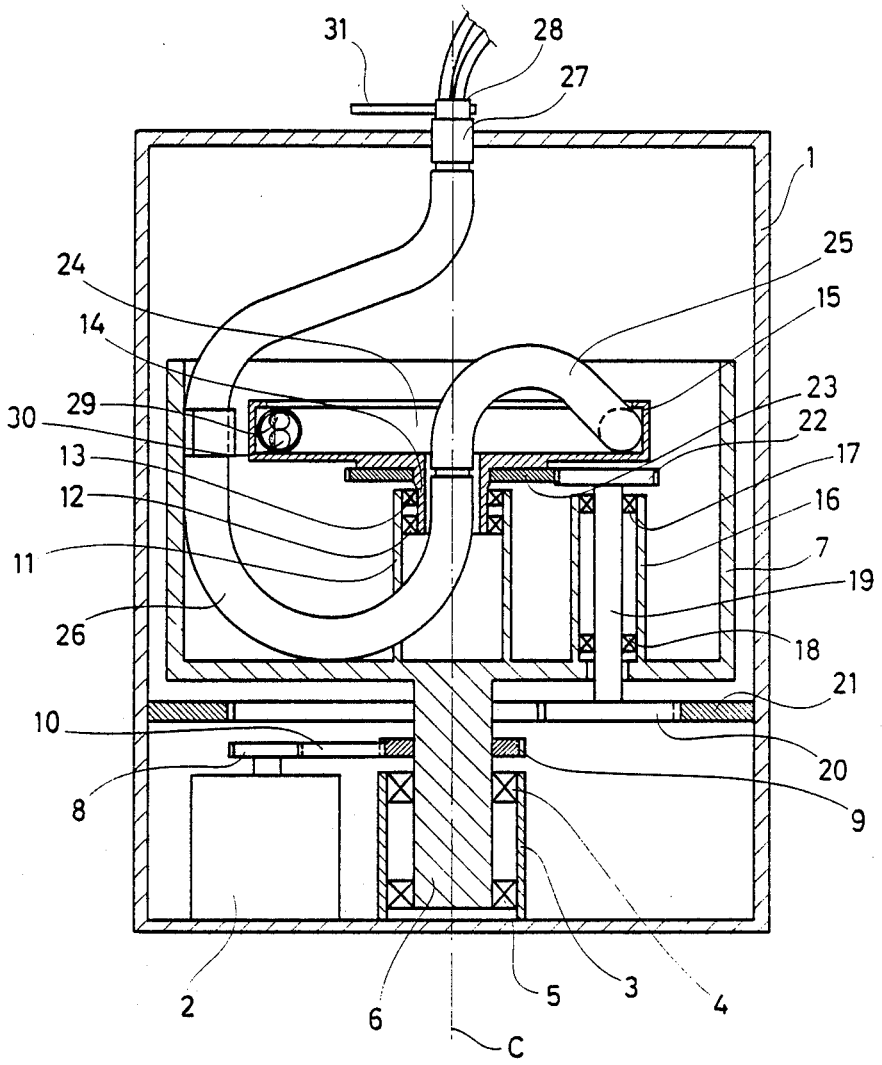
FIG. 1 shows a centrifugal separator according to the invention.

In FIG. 1 there is shown a centrifugal separator comprising a stationary housing 1, a motor 2 mounted therein, and a bearing housing 3. The bearing housing 3 supports two bearings 4 and 5, in which there is journalled a vertical spindle 6. The spindle is rotatable around an axis C. On the upper end of the spindle there is mounted an upwardly open cylindrical container 7. The motor 2 is arranged to rotate the spindle 6 through two gear wheels 8, 9 and a gear belt 10.

Mounted within the cylindrical container 7, coaxially therewith and on the bottom of the container is a central sleeve 11. On its inside the sleeve 11 supports two bearings 12 and 13, in which there is journalled a sleeve formed part 14 of a rotor body 15.

Spaced from the center axis of the container 7 there is mounted on the container bottom a further sleeve 16. This supports on its inside two bearings 17 and 18, in which there is journalled a vertical shaft 19. The shaft 19 extends down through an opening in the bottom of the container 7 and supports below this bottom a gear wheel 20. The gear wheel 20 is in engagement with a gear ring 21 firmly mounted on the inside of the stationary housing 1.

At its upper end the shaft 19 supports a gear wheel 22, which is in engagement with a gear wheel 23 mounted on and coaxially with the rotor body 15.

Within the rotor body 15 there is firmly mounted a pipe, having a first part 24 extending along the periphery of the rotor body and a second part 25 extending inwardly towards the rotational axis C of the rotor.

Within the container 7 there is firmly mounted a further pipe 26 which extends from the central end of the pipe part 25 downwardly into the sleeve 11, radially out through an opening in the surrounding wall of the sleeve 11, further upwardly within the container 7 and again towards the rotational axis C at the upper part of the housing 1.

Firmly mounted in the housing 1, coaxially with the rotor body 15, is a short sleeve 27 arranged opposite to the upper end of the pipe 26.

A flexible member 28 extends from the outside of the housing 1 in through the sleeve 27 and further through the pipe 26 and the pipe parts 25 and 24. Within the flexible member 28 there are two channels 29, 30, which in part form avenues for liquid transport to and from the rotor body, and in part form a separation chamber at the end portion of the flexible member 28 situated within the rotor body 15 close to its periphery.

The flexible member 28 has a smaller diameter than the sleeve 27 and the pipes 24–26, so that it can be rotated therein around its own longitudinal axis. Above the sleeve 27 there is a normally stationary but on occasion rotatable member 31 arranged in engagement with the flexible member 28 for intermittent rotation relative to the sleeve 27 and the pipes 24–26 during operation of the centrifugal separator.

The centrifugal separator shown in FIG. 1 operates in the following manner:

Upon start of the motor 2 the spindle 6 and the container 7 are brought into rotation. Then the sleeve 16 is moved in a course around the rotational axis C, the gear wheel 20 by its engagement with the stationary gear ring 21 causing the shaft 19 to rotate relative to the sleeve 16. This rotational movement is transferred through the gear wheels 22 and 23 to the rotor body 15, which thus is caused to rotate relative to the container 7. The different gear transmissions are so calculated that the rotor body 15 with the pipe parts 25 and 25 will rotate in the same direction as and at twice the speed of the container 7 and the pipe 26 around the rotational axis C.

By this arrangement for driving the rotor body it is possible to maintain one end of the flexible member 28 fixed relative to the housing 1 by means of the member 31, and the other end of the flexible member fixed relative to the rotor body 15, without getting the flexible member twisted durng rotation of the rotor body.

Independent of whether the rotor body 15 is rotating or not the flexible member 28 - when desired - may be rotated by means of the member 31 relative to the sleeve 27 and the pipes 24–26.

Figure 2:
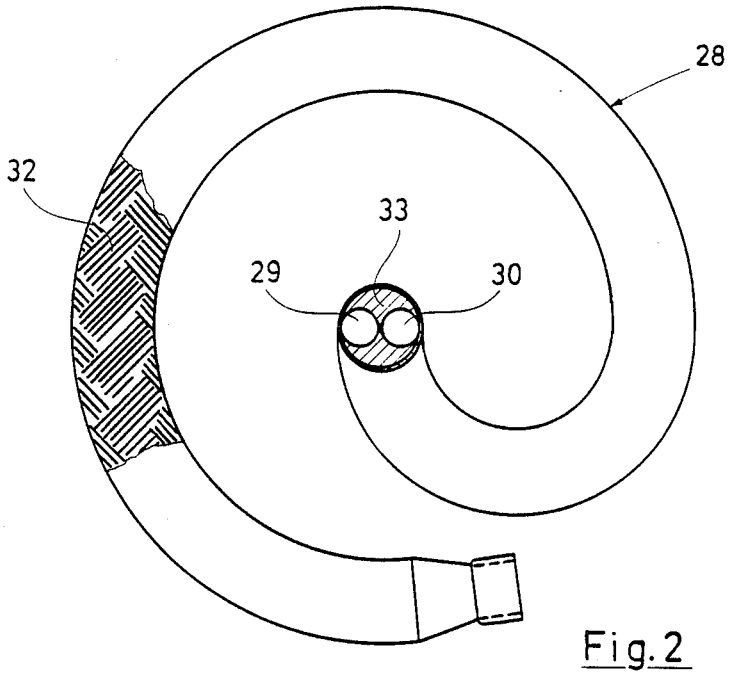
FIG. 2 shows a flexible member having two channels for liquid transport to and from a separation chamber in a centrifuge rotor.

In FIG. 2 there is shown a view of the part of the flexible member 28 which is situated within the rotor body 15. Along a part of the member 28 it is shown that it has an outer casing comprising threads 32, for instance of plastic or metal, which are interplaited. A certain number of threads thus extend helically with a certain pitch in one direction along the member 28, while a like number of threads - interplaited with the others - extend with a corresponding pitch in the other direction along the member 28.

The casing of threads 32 can be considered as a separate tube in which there is inserted a flexible member. A tube of this kind is flexible and can be extended or shortened, its diameter then being correspondingly changed. The dimensioning of the tube is made such that, after the flexible member has been inserted into the tube, the latter may be extended until it becomes the same length as the flexible member and this condition has an inner diameter which is as large as the outer diameter of the flexible member. In this way a desired surface engagement is obtained between the threads 32 and the flexible member and, simultaneously, the tube can be used for holding of the ends of the flexible member 28 relative to the housing and the rotor body 15. The threads 32 give the flexible member 28 a large torsional stiffness so that upon need it can be rotated around its own longitudinal axis by actuation by means of the member 31 at one of its ends.

Figure 3:
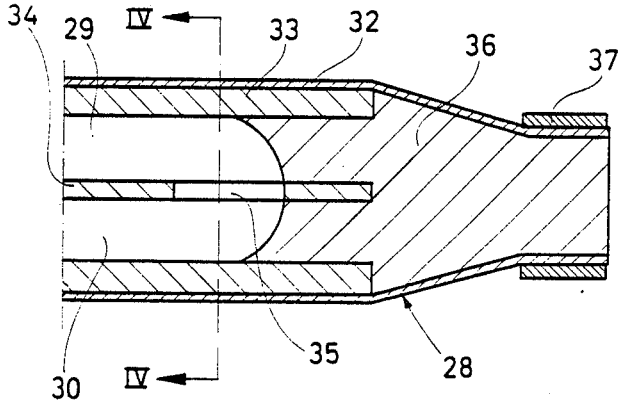
FIG. 3 shows a sectional view of an end portion of the flexible member of FIG. 2.

In FIG. 3 there is shown a longitudinal section through the end portion of the flexible member 28, intended to be situated in the rotor body 15. As can be seen, the flexible member 28 comprises the previously described outer tube of threads 32, which surrounds a hose 33, for instance of soft plastic, in which the two channels 29 and 30 are formed. Between the channels 29 and 30 a partition 34 is formed by the hose material. This partition is apertured a short distance from the end of the hose, so that a connecting opening 35 is formed between the channels 29 and 30. A closing member 36 is inserted into the hose 33 from its end, and a sleeve 37 is clamped the pipe against the closing member 36, which is thereby safely fixed within the hose 33.

Figure 4:
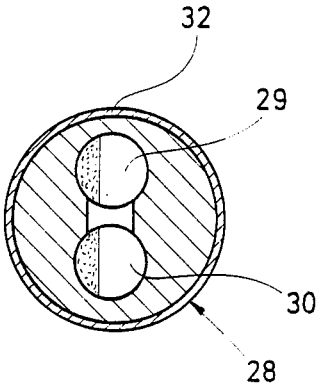
FIG. 4 shows a cross sectional view along the line IV—IV in FIG. 3.

In FIG. 4 there is shown a cross section along the line IV—IV in FIG. 3.

Figure 5:
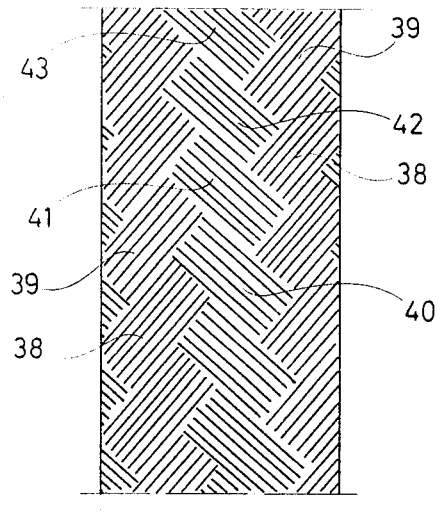
FIGS. 5 and 6 show alternative surface structures for a casing around a flexible member according to FIG. 2.
Figure 6:
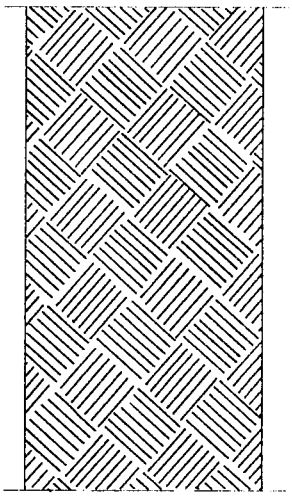

In FIGS. 5 and 6 there are shown alternative ways of interplaiting thread 32 of a casing of the kind surrounding a flexible member according to FIGS. 2–4.

FIG. 5 shows how two groups 38 and 39 of threads extending in parallel helically around the flexible member with a certain pitch, cross four groups 40–43 of threads situated beside each other and extending parallel to each other and helically around the flexible member but with a pitch directed opposite to the pitch of the threads 38 and 39. As can be seen from FIG. 5 the thread group 38 extends at the crossing places shown below the thread groups 40 and 41 but above the thread groups 42 and 43, whereas the thread group 39 extends above the thread groups 40 and 43 but below the thread groups 41 and 42.

Acceptable properties have been obtained from a casing of threads interplaited according to FIG. 5, which consists of twelve first thread groups extending in parallel in one direction and twelve second thread groups extending in parallel and crossing the twelve irst thread groups. Each group contains twelve threads of stainless steel with a diameter of 0.3 mm.

Another casing made of plastic threads interplaited in the same way also has obtained the desired properties, i.e., it has given a flexible member of the kind shown in FIGS. 2–4 with good torsional stiffness, good tensile strength and a wear resistant outside.

In this case the casing consisted of $2\times12$ groups of threads. Each group comprised four plastic threads with a diameter of 0.9 mm.

The casing of metal threads and the casing of plastic threads by axial expansion and compression can be given a diameter of between about 24 mm and 32 mm, respectively.

In FIG. 6 there is shown a modified way of interplaiting threads in a casing of the kind here in question. Several other ways of interplaiting threads in a casing of this kind are possible within the frame of the invention.

What is claimed is:

1. In a centrifugal separator comprising a rotor having a separation chamber, and rotatable about an axis having first and second ends and a flexible member forming at least one channel for fluid transport to or from the separation chamber during rotation of the rotor, the flexible member extending out from the rotor at one end of the rotor axis and around the periphery of the rotor at a distance from the rotor to a point aligned with the rotor axis at the other end of the rotor axis, the improvement comprising a torsionally stiff but flexible casing surrounding the flexible member, said casing comprising a plurality of first threads extending helically around the flexible member and a plurality of second threads extending helically around the flexible member with a pitch opposite to that of the first threads, said threads being plaited with each other to make said casing axially compressible and expandable during radial expansion and compression, respectively, said casing being expanded axially to the extent that through radial compression it is in frictional engagement with the flexible member.

2. Centrifugal separator according to claim 1 wherein said casing has ends and comprising means connecting said casing at its ends with the rotor and a member which is not rotatable with the rotor.

3. Centrifugal separator according to claim 1 wherein the flexible member consists of a hose having two or more internal channels.

4. Centrifugal separator according to claim 1 wherein the casing comprises a plurality of first threads, which are separated in groups extending helically around the flexible member and a plurality of second threads also separated in groups, said groups of first threads being interplaited with groups of second threads.

* * * * *